US007993473B2

(12) United States Patent
Kobessho et al.

(10) Patent No.: US 7,993,473 B2
(45) Date of Patent: Aug. 9, 2011

(54) HEAT TREATMENT OIL COMPOSITION

(75) Inventors: Masahiro Kobessho, Kanagawa (JP); Katsumi Ichitani, Chiba (JP); Makoto Takeishi, Chiba (JP); Yasuyuki Fujiwara, Aichi (JP); Yoshimi Aoyama, Aichi (JP)

(73) Assignees: Idemitsu Kosan Co., Ltd., Tokyo (JP); Toyota Jidosha Kabushiki Kaisha, Toyota-shi (JP)

( * ) Notice: Subject to any disclaimer, the term of this patent is extended or adjusted under 35 U.S.C. 154(b) by 22 days.

(21) Appl. No.: 11/912,436

(22) PCT Filed: Jun. 26, 2006

(86) PCT No.: PCT/JP2006/312721

§ 371 (c)(1),
(2), (4) Date: Mar. 5, 2008

(87) PCT Pub. No.: WO2007/000976

PCT Pub. Date: Jan. 4, 2007

(65) Prior Publication Data

US 2009/0056834 A1 Mar. 5, 2009

(30) Foreign Application Priority Data

Jun. 28, 2005 (JP) ..... 2005-188154

(51) Int. Cl.

| | |
|---|---|
| ***B23K 35/24*** | (2006.01) |
| *C10L 1/00* | (2006.01) |
| *H01B 3/22* | (2006.01) |

(52) U.S. Cl. ..... 148/29; 208/14

(58) Field of Classification Search ..... 148/29; 208/14; *B23K 35/00; C10L 1/00; C10M 171/00, C10M 171/02*

See application file for complete search history.

(56) References Cited

U.S. PATENT DOCUMENTS

| | | | | |
|---|---|---|---|---|
| 2003/0201205 | A1 * | 10/2003 | Ichitani et al. | 208/14 |
| 2004/0014617 | A1 * | 1/2004 | Koga et al. | 508/463 |

FOREIGN PATENT DOCUMENTS

| | | |
|---|---|---|
| JP | 10-158677 | 6/1998 |
| JP | 2001-192689 | 7/2001 |
| JP | 2002-327191 | 11/2002 |

* cited by examiner

*Primary Examiner* — Jessica L Ward
*Assistant Examiner* — Alexander Polyansky
(74) *Attorney, Agent, or Firm* — Oblon, Spivak, McClelland, Maier & Neustadt, L.L.P.

(57) ABSTRACT

The heat-treating oil composition of the present invention is characterized by comprising a mixed base oil containing a low-boiling base oil having a 5% distillation temperature of from 300 to 400° C. in an amount of not less than 5% by mass but less than 50% by mass, and a high-boiling base oil having a 5% distillation temperature of 500° C. or higher in an amount of more than 50% by mass but not more than 95% by mass. There is provided a quenching oil composition capable of exhibiting a less fluctuation in hardness or quenching distortion of a metal material treated therewith even when a large number of the metal materials are quenched therewith at the same time.

18 Claims, 1 Drawing Sheet

HEAT TREATMENT OIL COMPOSITION

BACKGROUND OF THE INVENTION

1. Field of the Invention

The present invention relates to heat-treating oil compositions, and more particularly to heat-treating oil compositions for quenching a metal material which hardly cause fluctuation in hardness or quenching distortion of the treated metal material even when a large number of the metal materials are quenched therewith at the same time.

2. Description of Related Arts

Metal materials such as steel materials are subjected to various heat treatments such as quenching (hardening), tempering, annealing and normalizing in order to improve properties thereof. Among these heat treatments, in the quenching treatment, for example, a heated steel material having an austenite structure is cooled at an upper critical cooling rate or more to transform the austenite structure into a hardened structure such as martensite. The steel material subjected to the quenching treatment has a very high hardness. In the quenching treatment, as a coolant, there have been generally used oil-based, water-based (aqueous solution-based) or emulsion-based heat-treating liquids. The quenching treatment for the steel material is explained below. When the heated steel material is put into the heat-treating liquid as the coolant, the cooling rate of the steel material is not kept constant, and usually varies via the following three stages. That is, the steel material is cooled through (1) the first stage (vapor blanket stage) in which the steel material is enclosed with a vapor blanket (film) of the heat-treating liquid, (2) the second stage (boiling stage) in which the vapor blanket is broken and the heat-treating liquid is boiled, and (3) the third stage (convection stage) in which the temperature of the steel material is decreased to a temperature lower than a boiling point of the heat-treating liquid so that heat is removed from the steel material by convection of the heat-treating liquid. Among these three cooling stages, the cooling rate of the second boiling stage is largest. The conventional heat-treating oils exhibit a rapid rise-up of thermal transmission showing a cooling power thereof, in particular, in the boiling stage, so that the material to be treated with the oils tends to undergo a very large temperature difference on a surface thereof under the transition condition between the vapor blanket stage and the boiling stage. With such a temperature difference, the material tends to suffer from thermal stress or transformation stress due to difference in heat shrinkage rate or transformation time between both the cooling stages, resulting in increase in quenching distortion thereof.

Upon the heat treatment of metals, in particular, upon quenching treatment thereof, it is important to select an appropriate heat-treating oil suitably used under the intended heat-treating conditions. The selection of inappropriate heat-treating oils tends to fail to impart a sufficient hardness to the material quenched, or tends to generate considerable distortion therein.

The heat-treating oils are generally classified into Types 1 to 3 according to JIS K2242. Among them, the heat-treating oils used for the quenching treatment include #1 and #2 oils of Type 1 and #1 and #2 oils of Type 2. In JIS K2242, as a measure of the cooling power of oils, it is prescribed that a cooling time (s) required for cooling a metal material from 800° C. to 400° C. when measured on the JIS cooling curve is 4.0 s or shorter for Type 1 #2 oil, 5.0 s or shorter for Type 2#1 oil, and 6.0 s or shorter for Type 2#2 oil. The shorter cooling time means the higher cooling power and, therefore, results in higher hardness of the heat-treated material. In general, the hardness and quenching distortion of the heat-treated material have a so-called trade-off relation to each other, i.e., the higher the hardness, the larger the quenching distortion becomes.

In addition, as an industrial index of a cooling power of quenching oils, there has been extensively used the H value which has been frequently described in catalogues, etc., distributed by the respective oil makers and used as a measure showing the cooling power of the quenching oils. The H value of the quenching oil is calculated from a cooling time required for cooling the metal material treated with the oil from 800° C. to 300° C. which is measured on the cooling curve prepared according to JIS K2242, and has been widely used to show the cooling power of the oil. The users can select a suitable quenching oil on the basis of the H value as an index to attain the aimed degrees of hardness and quenching distortion of the material to be treated. For example, the JIS Type 2 #1 oil has been extensively used for quenching gear parts for automobiles which tend to be adversely influenced by distortion generated therein. This is because the gear parts treated with the JIS Type 1 oils show not only a too large distortion but also a too high hardness in some kinds of the gear parts, whereas the gear parts treated with the JIS Type 2 #2 oil tend to lack in hardness notwithstanding a small distortion thereof.

Meanwhile, most of the parts for automobiles such as speed change gears and reduction gears are mass-produced, and a large number of these parts are stacked in one tray and subjected to quenching treatment at the same time, i.e., a so-called collective quenching. In such a collective quenching, the stacked parts to be quenched tend to undergo fluctuation in hardness or distortion due to the difference in positions in the tray. For example, upon the collective quenching, the parts set in a lower position of the tray tend to show a higher hardness, whereas those set in an upper position of the tray tend to show a lower hardness.

In order to prevent the parts treated in the stacked state from undergoing fluctuation in hardness or distortion thereof upon the collective quenching, there has been proposed the use of additional special devices such as vibrators and injectors (for example, refer to claims of Japanese Patent Application Laid-open No. 286517/2003). However, the use of such additional devices in the conventional apparatuses leads to high costs, and further it has been difficult to modify the conventional apparatuses when applying some kinds of devices thereto. Therefore, it has been demanded to develop techniques for preventing the above fluctuation in hardness or distortion of the parts treated with the quenching oils only by the effect of these oils without need of any additional investments for facilities.

Further, in the literature "Heat Treatment", Vol. 43, No. 2, pp. 93 to 98, it is described that when a material is treated with two kinds of base oils which have the same viscosity but are different in a 5% distillation temperature from each other (i.e., one base oil has a 5% distillation temperature of 350° C. or lower and the other has a 5% distillation temperature of more than 350° C.) to evaluate the hardness and distortion thereof, the material treated with the base oil having a 5% distillation temperature of 350° C. or lower shows a smaller distortion while maintaining a high hardness (refer to FIGS. 12 and 13 of the literature). However, the techniques described in the above literature have the following problems.

One of the problems resides in that the distortion is evaluated by warpage of the SUJ2 shaft part. The cooling process using the heat-treating oil proceeds through the vapor blanket stage, boiling stage and convection stage as described above. In the case of the parts having such a shaft shape, it is known that the distortion thereof is considerably influenced by change in vapor blanket breaking time in the vapor blanket stage and, therefore, the influence of a vapor blanket retention time (characteristic time (s)) rather than viscosity or boiling point of the heat-treating oil is more dominant for distortion of the parts treated therewith. Although no vapor blanket retention time is specified in the above literature, it is easily suggested from composition of the base oil used therein that the shorter vapor blanket retention time results in a smaller distortion of the parts treated therewith, since it is an ordinary tendency. Also, in the above literature, the distortion is evaluated using the SUJ2 part, whereas the hardness is evaluated using the S45C part, i.e., the two properties are evaluated using different materials from each other. For the purpose of obtaining such a heat-treating oil satisfying the requirements of both hardness and distortion, it is required to evaluate the hardness and distortion using the same material. If the distortion is evaluated with respect to the S45C part used for evaluating the hardness, it is expected that substantially no change in distortion between before and after the quenching treatment is observed due to poor quenching property thereof.

The other problem encountered in the above literature resides in that the oils studied therein have a relatively high cooling power close to that of the JIS Type 1 #2 oil, and such oils having a high cooling power are not usually used for the heat treatment of parts which tend to be adversely influenced by distortion generated therein. In general, the parts which tend to be adversely influenced by distortion generated therein are frequently treated with the heat-treating oils having a low cooling power which is capable of preventing these parts from undergoing distortion, such as JIS Type 2 #1 oil and, in some cases, JIS Type 2 #2 oil. For example, gears for automobiles have been extensively heat-treated with the JIS Type 2 #1 oil. Under these circumstances, in order to evaluate the distortion, the materials such as SCM420 and SCr420 which have been widely used for the parts for automobiles such as speed change gears, transmissions and reduction gears are preferably heat-treated with the JIS Type 2 #1 oil.

The present inventors have already proposed the heat-treating oil composition capable of not only preventing a metal material from undergoing cooling unevenness when quenched therewith to ensure an adequate hardness of the quenched metal material, but also reducing the quenching distortion generated therein, which contains a mixed base oil composed of a low-viscosity base oil having a kinematic viscosity at 40° C. of 5 to 60 $mm^2/s$ and a high-viscosity base oil having a kinematic viscosity at 40° C. of 300 $mm^2/s$ or higher (refer to claims of Japanese Patent Application Laid-open No. 327191/2002). However, according to the subsequent studies made by the present inventors, it has been found that when the heat-treating oil compositions containing the low-viscosity base oil in an amount of 50% by weight or more as described in Examples of the above Japanese Patent Application are used for quenching the parts such as gears for automobiles, the thus treated parts show a too high hardness.

SUMMARY OF THE INVENTION

The present invention has been made in view of the above conventional problems. An object of the present invention is to provide a quenching oil capable of exhibiting a less fluctuation in cooling power upon collective quenching, in particular, a quenching oil composition capable of effectively preventing occurrence of fluctuation in cooling power upon collective quenching while maintaining the substantially same cooling power as that of the JIS Type 2 #1 oil used for quenching the parts for automobiles such as speed change gears and reduction gears which tend to be adversely influenced by distortion generated therein.

As a result of intensive and extensive researches to achieve the above object, the inventors have found that the fluctuation in cooling power upon collective quenching is caused by local difference in oil temperature due to heating by the material to be treated, difference in flow rate of the oil between upstream and downstream sides of the material to be treated, difference in oil pressure, etc., and among them, the difference in flow rate of the oil has a larger influence on the fluctuation in cooling power thereof.

In addition, as a result of further studies concerning the influence of agitation on cooling power for obtaining a quenching oil capable of exhibiting a less fluctuation in cooling power due to the difference in flow rate of the oil, it has been found that the heat-treating oil composed of combination of a low-boiling base oil and a high-boiling base oil can be inhibited from undergoing the fluctuation in cooling power and hardness owing to agitation as compared to the conventional JIS Type 2 #1 oil. Further, as a result of actually performing collective quenching of gears with the above oil composition, it has been found that the thus treated gears can be prevented from suffering from, in particular, fluctuation in hardness as well as dimensional accuracy of the gears. The present invention has been accomplished on the basis of the above findings.

Thus, the present invention provides:

(1) A heat-treating oil composition comprising a mixed base oil containing a low-boiling base oil having a 5% distillation temperature of from 300 to 400° C. in an amount of not less than 5% by mass but less than 50% by mass, and a high-boiling base oil having a 5% distillation temperature of 500° C. or higher in an amount of more than 50% by mass but not more than 95% by mass.

(2) The heat-treating oil composition as described in the above aspect (1), wherein a content of said low-boiling base oil in the mixed base oil is not less than 10% by mass but less than 50% by mass, and a content of said high-boiling base oil in the mixed base oil is more than 50% by mass but not more than 90% by mass.

(3) The heat-treating oil composition as described in the above aspect (1) or (2), wherein said composition has a 300° C. cooling time of 7.5 to 12.3 s as measured by a cooling power test according to JIS K2242.

(4) The heat-treating oil composition as described in any one of the above aspects (1) to (3), further comprising a vapor blanket breaking agent.

EFFECT OF THE INVENTION

In accordance with the present invention, there can be obtained a quenching oil capable of exhibiting a less fluctuation in cooling power upon collective quenching, in particular, such a quenching oil capable of preventing the fluctuation in cooling power thereof upon collective quenching while maintaining the substantially same cooling power as that of the JIS Type 2 #1 oil used for quenching the parts such as gears of transmissions for automobiles which tend to be adverse influenced by distortion generated therein.

DETAILED DESCRIPTION OF THE INVENTION

Figure 1:
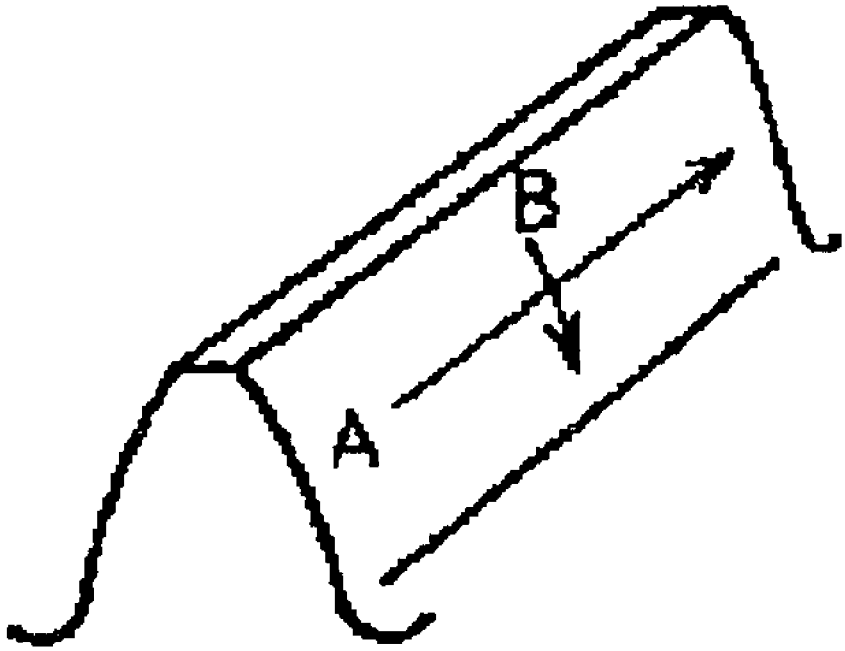
FIG. 1 is a schematic view showing a gear part for explaining a relation between helix angle error A and pressure angle error B.

The heat-treating oil composition of the present invention is characterized by comprising a low-boiling base oil having a 5% distillation temperature of from 300° C. to 400° C. (hereinafter referred to as the "low-boiling base oil of the present invention") and a high-boiling base oil having a 5% distillation temperature of 500° C. or higher (hereinafter referred to as the "high-boiling base oil of the present invention"). The term "5% distillation temperature" used herein means the temperature at which 5% of an oil is distilled off as measured by "Reference: Distillation Testing Method for Petroleum Fractions by Gas Chromatography" of "Petroleum Products-Distillation Test" according to JIS K2254.

When the 5% distillation temperature of the low-boiling base oil as a constituent of the mixed base oil is out of the above-specified range of from 300° C. to 400° C., the resultant oil composition fails to exhibit the aimed effects of the present invention. In particular, when such a low-boiling base oil having a 5% distillation temperature of lower than 300° C. is used in a predetermined amount or more, there tends to arise such a problem that a large amount of lamp black is generated upon use.

On the other hand, when the 5% distillation temperature of the high-boiling base oil as a constituent of the mixed base oil is lower than 500° C., the cooling power of the resultant oil composition tends to be fluctuated upon collective quenching.

The content of the low-boiling base oil in the heat-treating oil composition of the present invention is in the range of not less than 5% by mass but less than 50% by mass on the basis of the mixed base oil. When the content of the low-boiling base oil is less than 5% by mass, the resultant oil composition fails to sufficiently exhibit the aimed effects of the present invention. On the other hand, when the content of the low-boiling base oil is 50% by mass or more, the hardness of the material treated with the resultant oil composition tends to become too high. From these viewpoints, the content of the low-boiling base oil in the heat-treating oil composition of the present invention is preferably in the range of not less than 10% by mass but less than 50% by mass on the basis of the mixed base oil.

The content of the high-boiling base oil in the heat-treating oil composition of the present invention is in the range of more than 50% by mass but not more than 95% by mass on the basis of the mixed base oil. When the content of the high-boiling base oil is 50% by mass or less, the hardness of the material treated with the resultant oil composition tends to become too high. On the other hand, when the content of the high-boiling base oil is more than 95% by mass, the cooling power of the resultant oil composition tends to be fluctuated upon collective quenching.

The distillation properties of the heat-treating oil composition of the present invention other than the above 5% distillation temperature are not particularly limited. However, the heat-treating oil composition of the present invention preferably exhibits an initial boiling point of 250 to 350° C., a 50% distillation temperature of 360 to 460° C. and a 95% distillation temperature of 400 to 500° C. The heat-treating oil composition satisfying the above initial boiling point can be prevented from undergoing generation of lamp black therefrom, whereas the heat-treating oil composition satisfying the above 50% distillation temperature and 95% distillation temperature can be prevented from undergoing excessive increase in hardness of the material treated therewith.

As the low-boiling base oil and the high-boiling base oil used in the present invention, there may be used mineral oils and synthetic oils. Examples of the mineral oils include any fractions such as paraffin-based mineral oils, naphthene-based mineral oils and aromatic mineral oils. In addition, there may also be used those obtained by subjecting these mineral oils to a refining process such as solvent refining, hydrogenation refining and hydrocracking. Examples of the synthetic oils include alkyl benzenes, alkyl naphthalenes, α-olefin oligomers and hindered ester oils.

In the heat-treating oil composition of the present invention, the low-boiling base oil and the high-boiling base oil may be respectively constituted of one of the above mineral oils, combination of any two or more of the mineral oils, one of the above synthetic oils, combination of any two or more of the synthetic oils, or combination of at least one of the mineral oils and at least one of the synthetic oils.

Also, the heat-treating oil composition of the present invention may contain, in addition to the above mixed base oil, other base oils unless the addition thereof adversely affects the aimed effects of the present invention.

The heat-treating oil composition of the present invention may further contain a vapor blanket breaking agent in order to shorten the vapor blanket stage. Examples of the vapor blanket breaking agent include high-molecular polymers, more specifically, such as ethylene-α-olefin copolymers, polyolefins and polymethacrylates; high-molecular organic compounds such as asphaltum; and oil-dispersible inorganic materials. These vapor blanket breaking agents may be used alone or combination of any two or more thereof.

The content of the vapor blanket breaking agent in the heat-treating oil composition is usually from 1 to 10% by mass and preferably from 3 to 6% by mass. When the content of the vapor blanket breaking agent is 1% by mass or more, the effect of addition of the vapor blanket breaking agent can be sufficiently exhibited. Whereas, when the content of the vapor blanket breaking agent is 10% by mass or less, the resultant heat-treating oil composition can be prevented from undergoing excessive increase in viscosity, i.e., can exhibit an adequate viscosity, and can be therefore inhibited from being deteriorated in properties thereof. The heat-treating oil composition of the present invention which contains the vapor blanket breaking agent in the above specified amount enables the vapor blanket stage to be shortened, and can be prevented from undergoing increase in the cooling power during the boiling stage, resulting in reduction of quenching distortion caused owing to fluctuation in cooling power. Further, the above heat-treating oil composition enables the temperature range of the boiling stage to be broadened, thereby ensuring a suitable hardness of the material treated therewith.

The heat-treating oil composition of the present invention preferably has a 300° C. cooling time of 7.5 to 12.3 s as measured by the cooling power test according to JIS K2242. The term "300° C. cooling time" used herein means the time (s) required for cooling a test piece from 800° C. to 300° C. using the heat-treating oil composition as measured by the cooling power test according to JIS K2242. When the 300° C. cooling time is shorter than 7.5 s, the hardness of the material treated tends to become too high. On the other hand, when the 300° C. cooling time is longer than 12.3 s, the treated material tends to lack in hardness. From these viewpoints, the 300° C. cooling time of the heat-treating oil composition of the present invention as measured by the cooling power test according to JIS K2242 is more preferably in the range of from 7.5 to 10.0 s.

In addition, the heat-treating oil composition of the present invention preferably has a kinematic viscosity at 100° C. of from 5 to 50 $mm^2/s$. When the kinematic viscosity at 100° C.

of the heat-treating oil composition is 5 $mm^2/s$ or more, the treated material can be prevented from undergoing excessive increase in hardness, and firing risk of the composition can be suitably lowered. On the other hand, when the kinematic viscosity at 100° C. of the heat-treating oil composition is 50 $mm^2/s$ or less, the treated material can exhibit a sufficient hardness, and can be prevented from being deteriorated in detergency. From these viewpoints, the kinematic viscosity at 100° C. of the heat-treating oil composition of the present invention is more preferably in the range of from 8 to 35 $mm^2/s$.

Furthermore, the heat-treating oil composition of the present invention may also contain various additives ordinarily used in the conventional heat-treating oils, if required. Examples of the additives include surfactants, deteriorated-acid neutralizing agents, antioxidants and brightness improving agents.

Examples of the surfactants include salicylates, sulfonates, sulfinates, etc., of alkali earth metals or alkali metals. Examples of the preferred alkali earth metals include calcium, barium and magnesium. Examples of the preferred alkali metals include potassium and sodium. The content of the surfactant is in the range of usually from 0.1 to 10% by mass and preferably from 0.2 to 7% by mass on the basis of a whole amount of the heat-treating oil composition.

Examples of the deteriorated-acid neutralizing agents include salicylates, sulfinates, sulfonates, etc., of alkali earth metals. Examples of the preferred alkali earth metals include calcium, barium and magnesium. Examples of the antioxidants include those conventionally known in the art such as amine-based antioxidants and hindered phenol-based antioxidants. Examples of the brightness improving agents include those conventionally known in the art such as oils and fats, fatty acids derived from fats and oils, alkenyl succinimide and substituted hydroxy aromatic carboxylic ester derivatives.

The heat-treating oil composition of the present invention can be suitably used in heat-treating processes such as carburizing quenching, carbonitriding quenching and vacuum quenching for the purpose of improving properties of metal materials such as steel materials.

EXAMPLES

The present invention will be described in more detail by referring to the following examples. However, it should be noted that these examples are only illustrative and not intended to limit the invention thereto. Meanwhile, various properties of the heat-treating oil compositions were measured by the following methods.

(1) Evaluation 1: Change in Hardness Due to Agitation (Test Piece: Round Bar)

Using a modified apparatus of a testing machine for evaluating a cooling power according to JIS K2242, the change in hardness due to agitation was evaluated. The apparatus was of a closed type capable of controlling an atmosphere therein, and had such a structure capable of heating a steel piece fitted to a silver alumel piece portion thereof and then quenching the thus heated steel piece in an oil. It took about 2 s until the steel piece heated in a heating oven was transported and put into the oil. Thus, in the apparatus used, since the temperature drop due to the transportation was small, the hardness of the material treated therein was slightly higher as compared to those treated in the other apparatuses under the same conditions. The material and measuring conditions were as follows.

Test piece: SCM420 round bar having a size of ϕ 16 mm×30 mm in length was used.

Heat-treating conditions: Heated at 860° C. for 30 min in a pure nitrogen atmosphere.

Oil-cooling conditions: Cooled at an oil temperature of 120° C. for 3 min with or without agitation (corresponding to 30 cm/s).

Evaluation: The test piece was cut into halves at its center in an axial direction thereof, and a section of the cut piece was polished to measure a hardness thereof at a mid (½) position of a radius of the section in terms of a Rockwell hardness (C-scale HRC) prescribed in JIS Z2245. The hardness of it was measured at eight positions on the section to calculate an average value thereof.

(2) Evaluation 2: Change in Accuracy and Hardness Due to Agitation (Test Piece: Gear)

The test piece made of the below-mentioned material was heat-treated under the following conditions to evaluate a gear profile accuracy and a hardness thereof. As evaluation items of the gear profile accuracy, as shown in FIG. 1, there were measured a pressure angle error (tooth profile error) B and a helix angle error (tooth trace error) A on the gear surface. The amount of change in pressure angle error and the amount of change in helix angle error were respectively indicated by the amount of change in each error between before and after the quenching treatment. Further, the hardness was evaluated by a Vickers hardness (HV according to JIS Z2244) as measured at a deddendum of the gear as well as an effective case depth (according to JIS G0557). Meanwhile, as the criteria for the effective case depth, there was used HV513 prescribed in the old JIS.

Test piece: SCM420 differential drive pinion (module 2.43)

Heat-treating conditions: After the test piece was heated in a heating chamber of a heat-treating furnace at 950° C., a carburizing atmospheric gas was fed thereinto at a carbon potential (CP) of 1.0% by mass. The test piece was held in the carburizing atmosphere for 150 min (carburizing step). Then, after the CP value was adjusted to 0.8% by mass, the test piece was further held in the atmosphere for 60 min (diffusion step). Thereafter, the test piece was allowed to stand in the furnace until cooling the test piece to 860° C., and further held for 30 min in the atmosphere maintained at a CP value of 0.8% by mass (soaking or equalizing step).

Oil-cooling conditions: Cooled at an oil temperature of 130° C. for 4 min under weak agitation (corresponding to 20 cm/s) and under strong agitation (corresponding to 55 cm/s).

(3) Evaluation 3: Evaluation of Fluctuation in Distortion Upon Collective Quenching (Test Piece: Gear)

The test piece made of the below-mentioned material was heat-treated under the following conditions to evaluate fluctuation 6σ in amount of change in each of a pressure angle error (tooth profile error) and a helix angle error (tooth trace error).

Test piece: SCM420 differential drive pinion (module 2.43)

Heat-treating conditions:

Carburizing step: 950° C.×100 min; CP=1.0% by mass

Diffusion step: 950° C.×70 min; CP=0.8% by mass

Soaking or equalizing step: 860° C.×30 min; CP=0.8% by mass

Oil-cooling conditions: Oil temperature: 130° C.; Cooling time: 4 min

Properties of the low-boiling base oils used in Examples and Comparative Examples are shown in Table 1, and properties of the high-boiling base oils used therein are shown in Table 2.

TABLE 1

| | | Low-boiling base oil | | | | |
|---|---|---|---|---|---|---|
| | | L-1 | L-2 | L-3 | L-4 | L-5 |
| Kinematic viscosity at 40° C. ($mm^2/s$) | | 32.21 | 20.44 | 12.53 | 7.976 | 4.078 |
| Kinematic viscosity at 100° C. ($mm^2/s$) | | 5.357 | 4.284 | 3.119 | 2.252 | 1.446 |
| Distillation properties (° C.) | Initial boiling point | 321 | 344 | 284.4 | 252 | 275 |
| | 5% distillation temperature | 358 | 375 | 318.5 | 275 | 278.5 |
| | 50% distillation temperature | 423 | 424 | 382.9 | 329 | 282.5 |
| | 95% distillation temperature | 479 | 463 | 430.5 | 406 | 292 |
| | Terminal point | 496 | 474 | 435 | 472 | 295 |

TABLE 2

| | | High-boiling base oil | | |
|---|---|---|---|---|
| | | H-1 | H-2 | H-3 |
| Kinematic viscosity at 40° C. ($mm^2/s$) | | 408.8 | 89.41 | 75.23 |
| Kinematic viscosity at 100° C. ($mm^2/s$) | | 30.86 | 10.7 | 9.286 |
| Distillation properties (° C.) | Initial boiling point | 465 | 405 | 335 |
| | 5% distillation temperature | 530 | 463 | 447 |
| | 50% distillation temperature | 597 | 506 | 487 |
| | 95% distillation temperature | — | 578 | 528 |
| | Terminal point | — | 610 | 540 |

Examples 1 to 8 and Comparative Examples 1 to 13

The respective components were blended with each other at a mixing ratio shown in Table 3 to prepare heat-treating oil compositions. The thus prepared heat-treating oil compositions were subjected to the above Evaluation 1. The results are shown in Table 3. In addition, the heat-treating oil compositions obtained in Example 3 and Comparative Example 5 were further subjected to the above Evaluation 2 and Evaluation 3. The results are shown in Table 4.

TABLE 3

| | | Examples | | | | | | | |
|---|---|---|---|---|---|---|---|---|---|
| | | 1 | 2 | 3 | 4 | 5 | 6 | 7 | 8 |
| Low-boiling base oil (mass %) | L-1 | 25 | — | — | — | — | — | — | — |
| | L-2 | — | 25 | — | — | — | — | — | — |
| | L-3 | — | — | 25 | 9 | 19 | 29 | 39 | 49 |
| | L-4 | — | — | — | — | — | — | — | — |
| | L-5 | — | — | — | — | — | — | — | — |
| High-boiling base oil (mass %) | H-1 | 74 | 74 | 74 | 90 | 80 | 70 | 60 | 50 |
| | H-2 | — | — | — | — | — | — | — | — |
| | H-3 | — | — | — | — | — | — | — | — |
| Surfactant*1 (mass %) | | 1 | 1 | 1 | 1 | 1 | 1 | 1 | 1 |
| Vapor blanket breaking agent A*2 (mass %) | | — | — | — | — | — | — | — | — |
| Vapor blanket breaking agent B*3 (mass %) | | — | — | — | — | — | — | — | — |
| Hardness (HRC) | without agitation | 32.7 | 33.0 | 34.9 | 33.5 | 34.0 | 37.9 | 38.3 | 39.2 |
| | under agitation | 35.3 | 35.2 | 37.2 | 35.5 | 36.3 | 40.3 | 40.4 | 41.3 |
| Difference in hardness (HRC) | | 2.6 | 2.2 | 2.3 | 2.0 | 2.3 | 2.4 | 2.1 | 2.1 |
| 300° C. cooling time (s) | | 9.29 | 9.04 | 8.29 | 8.81 | 8.38 | 8.46 | 7.85 | 7.6 |

| | | Comparative Examples | | | | | | | |
|---|---|---|---|---|---|---|---|---|---|
| | | 1 | 2 | 3 | 4 | 5 | 6 | 7 | 8 |
| Low-boiling base oil (mass %) | L-1 | — | 97 | — | — | — | — | — | — |
| | L-2 | 100 | — | — | — | — | — | — | — |
| | L-3 | — | — | 95 | — | — | — | — | — |
| | L-4 | — | — | — | — | — | — | 25 | — |
| | L-5 | — | — | — | — | — | — | — | 25 |
| High-boiling base oil (mass %) | H-1 | — | — | — | — | 50 | 74 | 74 | 74 |
| | H-2 | — | — | — | 99 | 49 | — | — | — |
| | H-3 | — | — | — | — | — | 25 | — | — |
| Surfactant*1 (mass %) | | — | — | — | 1 | 1 | 1 | 1 | 1 |

TABLE 3-continued

| | | | | | | | | | |
|---|---|---|---|---|---|---|---|---|---|
| Vapor blanket breaking agent A*2 (mass %) | | — | 3 | — | — | — | — | — | — |
| Vapor blanket breaking agent B*3 (mass %) | | — | — | 5 | — | — | — | — | — |
| Hardness (HRC) | without agitation | 36.7 | 36.1 | 41.1 | 32.3 | 31.6 | 31.7 | X*4 | X*4 |
| | under agitation | 40.7 | 40.4 | 43.1 | 36.1 | 34.8 | 34.7 | X*4 | X*4 |
| Difference in hardness (HRC) | | 4.0 | 4.3 | 2.0 | 3.8 | 3.2 | 3.0 | — | — |
| 30° C. cooling time (s) | | 8.34 | 7.25 | 5.14 | 9.07 | 9.72 | 9.38 | — | — |

| | | Comparative Examples | | | | |
|---|---|---|---|---|---|---|
| | | 9 | 10 | 11 | 12 | 13 |
| Low-boiling base oil (mass %) | L-1 | — | — | — | — | — |
| | L-2 | — | — | — | — | — |
| | L-3 | — | 60 | 70 | 80 | 99 |
| | L-4 | — | — | — | — | — |
| | L-5 | — | — | — | — | — |
| High-boiling base oil (mass %) | H-1 | 99 | 39 | 29 | 19 | — |
| | H-2 | — | — | — | — | — |
| | H-3 | — | — | — | — | — |
| Surfactant*1 (mass %) | | 1 | 1 | 1 | 1 | 1 |
| Vapor blanket breaking agent A*2 (mass %) | | — | — | — | — | — |
| Vapor blanket breaking agent B*3 (mass %) | | — | — | — | — | — |
| Hardness (HRC) | without agitation | 30.5 | 40.2 | 40.1 | 41.4 | 42 |
| | under agitation | 34.2 | 42.4 | 41.9 | 42.9 | 43.5 |
| Difference in hardness (HRC) | | 3.7 | 2.2 | 1.8 | 1.5 | 1.5 |
| 300° C. cooling time (s) | | 10.1 | 7.4 | 6.6 | 5.9 | 6.0 |

Note:

*1Surfactant "Ca Sulfonate 78W" available from The Lubrizol Corp.

*2Vapor blanket breaking agent A "Idemitsu Polybutene 2000H" available from Idemitsu Kosan Co., Ltd.

*3Vapor blanket breaking agent B "NC505" available from Nippon Chemicals Sales Co., Ltd.

*4X: Quenching test was not possible because of a too large amount of lamp black generated.

TABLE 4

| | | Example 3 | Com. Ex. 5 |
|---|---|---|---|
| Low-boiling base oil (mass %) | L-1 | — | 97 |
| | L-2 | — | — |
| | L-3 | 25 | — |
| | L-4 | — | — |
| | L-5 | — | — |
| High-boiling base oil (mass %) | H-1 | 74 | 50 |
| | H-2 | — | 49 |
| | H-3 | — | — |
| Additives (mass %) | Surfactant*1 (mass %) | 1 | 1 |
| | Vapor blanket breaking agent A*2 | — | — |
| | Vapor blanket breaking agent B*3 | — | — |
| Evaluation 2 | Change in pressure angle error (μm) under weak agitation | 2.85 | 2.32 |
| | Change in pressure angle error (μm) under strong agitation | 3.39 | 1.78 |
| | Difference in change in pressure angle error (μm) due to change in agitation intensity | 0.54 | 0.54 |
| | Change in helix angle error (μm) under weak agitation | 5.90 | 4.54 |
| | Change in helix angle error (μm) under strong agitation | 7.27 | 10.00 |
| | Difference in change in helix angle error (μm) due to change in agitation intensity | 1.37 | 5.46 |
| | Deddendum hardness (HV) under weak agitation | 293 | 274 |
| | Deddendum hardness (HV) under strong agitation | 310 | 309 |
| | Difference in deddendum hardness (HV) due to change in agitation intensity | 17 | 35 |

TABLE 4-continued

| | | Example 3 | Com. Ex. 5 |
|---|---|---|---|
| | Effective case depth (mm) under weak agitation | 0.77 | 0.53 |
| | Effective case depth (mm) under strong agitation | 0.90 | 0.73 |
| | Difference in effective case depth (mm) due to change in agitation intensity | 0.13 | 0.20 |
| Evaluation 3 | Fluctuation 6σ in change in pressure angle error (μm) | 2.6 | 3.8 |
| | Fluctuation 6σ in change in helix angle error (μm) | 6.0 | 11.2 |

In the Evaluation 1, the difference in hardness between the test piece treated without agitation and that treated under agitation is preferably small. The heat-treating oil composition exhibiting such a small difference in hardness of the test piece also shows a small fluctuation in a cooling power thereof upon collective quenching. It was confirmed that the heat-treating oil compositions obtained in Examples 1 to 8 all exhibited the difference in hardness as small as less than 3 HRC and, therefore, showed a good cooling power. Also, in the case of parts exposed to severe impact load such as gears for transmissions of automobiles, the hardness of these parts treated without agitation is preferably less than 40 HRC in view of a good impact resistance thereof. The heat-treating oil compositions obtained in Examples 1 to 8 all fulfilled the above hardness value.

Further, the heat-treating oil compositions obtained in Examples 1 to 8 all exhibited a 300° C. cooling time ranging from 7.5 to 10.0 s and, therefore, the test piece heat-treated with the heat-treating oil compositions showed an adequate hardness. On the other hand, the heat-treating oil compositions obtained in Comparative Examples 2, 3 and 10 to 13 exhibited a 300° C. cooling time of less than 7.5 s, and the test piece treated with such heat-treating oil compositions showed a too high hardness.

Next, in the Evaluation 2 using the heat-treating oil compositions obtained in Example 3 and Comparative Example 5, the heat-treating oil composition obtained in Example 3 was the substantially identical in the difference in amount of change in pressure angle error (μm) due to change in intensity of agitation, to that of the heat-treating oil composition obtained in Comparative Example 5, but was considerably small in the difference in amount of change in helix angle error (μm) due to change in intensity of agitation as compared to that of the heat-treating oil composition obtained in Comparative Example 5. More specifically, although the difference in amount of change in helix angle error (μm) is a factor strongly influenced by the agitation speed, the heat-treating oil compositions of the present invention had a less influence on such a quality even when the flow velocity of the heat-treating oil composition is varied.

Also, it was confirmed that the test piece treated with the heat-treating oil composition obtained in Example 3 showed a deddendum hardness which was identical to or higher than that treated with the heat-treating oil composition obtained in Comparative Example 5 corresponding to the JIS Type 2 #1 oil. In addition, the heat-treating oil composition obtained in Example 3 exhibited a less difference in the deddendum hardness due to change in intensity of agitation as compared to the heat-treating oil composition obtained in Comparative Example 5. Therefore, it was confirmed that the change in flow velocity of the heat-treating oil composition obtained in Example 3 had a less influence on the deddendum hardness as compared to the heat-treating oil composition obtained in Comparative Example 5.

Further, the heat-treating oil composition obtained in Example 3 also exhibited an effective case depth identical to or higher than that of the heat-treating oil composition obtained in Comparative Example 5. Besides, the heat-treating oil composition obtained in Example 3 had a less influence on the effective case depth due to change in flow velocity thereof as compared to the heat-treating oil composition obtained in Comparative Example 5.

In the Evaluation 3, it was confirmed that the heat-treating oil composition obtained in Example 3 showed a less fluctuation in amount of change in helix angle error upon actual collective quenching as compared to the heat-treating oil composition obtained in Comparative Example 5. In addition, in the Evaluation 2, the heat-treating oil composition obtained in Example 3 exhibited the substantially same difference in amount of change in pressure angle error to that of the heat-treating oil composition obtained in Comparative Example 5. However, upon actual collective quenching, it was confirmed that the heat-treating oil composition obtained in Example 3 apparently exhibited a less fluctuation in amount of change in pressure angle error as compared to that of the heat-treating oil composition obtained in Comparative Example 5.

INDUSTRIAL APPLICABILITY

The heat-treating oil composition of the present invention hardly causes fluctuation in hardness or quenching distortion of a metal material treated therewith even when a large number of the metal materials are quenched therewith at the same time. In particular, there is provided a quenching oil composition capable of exhibiting a less fluctuation in cooling power upon collective quenching while maintaining the substantially same cooling power as that of the JIS Type 2 #1 oil which has been ordinarily used for quenching the parts for automobiles such as gears.

What is claimed is:

1. A heat-treating oil composition comprising:

a mixed base oil containing a first base oil having a 5% distillation temperature of from 300 to 400° C. in an amount of not less than 5% by mass but no more than 25% by mass, and a second base oil having a 5% distillation temperature of 500° C. or higher in an amount of more than 50% by mass but not more than 95% by mass.

2. The heat-treating oil composition according to claim 1, wherein a content of said first base oil in the mixed base oil is not less than 10% by mass, and a content of said second base oil in the mixed base oil is more than 50% by mass but not more than 90% by mass.

3. The heat-treating oil composition according to claim 1, wherein said composition has a 300° C. cooling time of 7.5 to 12.3 s as measured by a cooling power test according to JIS K2242.

4. The heat-treating oil composition according to claim 1, further comprising a vapor blanket breaking agent.

5. The heat-treating oil composition according to claim 4, wherein the vapor blanket breaking agent comprises from 1 to 10% of the mass of the composition.

6. The heat-treating oil composition according to claim 5, wherein the vapor blanket breaking agent comprises from 3 to 6% of the mass of the composition.

7. The heat-treating oil composition according to claim 1, wherein the composition has an initial boiling point of 250° to 350° C.

8. The heat-treating oil composition according to claim 1, wherein the composition has a 95% distillation temperature of from 400° to 500° C.

9. The heat-treating oil composition according to claim 1, wherein the composition has a kinematic viscosity at 100° C. of from 8 to 35 $mm^2/s$.

10. The heat-treating oil composition according to claim 1, wherein the composition includes a surfactant.

11. The heating-treating oil composition according to claim 10, wherein the surfactant includes a salicylate.

12. The heating-treating oil composition according to claim 10, wherein the surfactant includes at least one of calcium, barium, or magnesium.

13. The heating-treating oil composition according to claim 1, wherein the composition has a same cooling power as JIS Type 2 #1 oil.

14. The heating-treating oil composition according to claim 6, wherein the vapor blanket agent includes asphaltum.

15. The heating-treating oil composition according to claim 1, wherein the first base oil is present in an amount of 25% by mass.

16. The heating-treating oil composition according to claim 15, wherein the second base oil is present in an amount of 74% by mass.

17. The heating-treating oil composition according to claim 16, wherein the composition includes 1% by mass of surfactant.

18. A heat-treating oil composition comprising:

a mixed base oil containing a first base oil having a 5% distillation temperature of from 300 to 400° C. in an amount of not less than 5% by mass but less than 50% by mass, and a second base oil having a 5% distillation temperature of 500° C. or higher in an amount of at least 74% by mass but not more than 95% by mass.

* * * * *